United States Patent [19]

Bertrand

[11] Patent Number: 5,035,324

[45] Date of Patent: Jul. 30, 1991

[54] TOY PACKAGING

[75] Inventor: Victor J. Bertrand, Ile Bizard, Canada

[73] Assignee: The Ritvik Group Inc., Dorval, Canada

[21] Appl. No.: 476,250

[22] Filed: Feb. 7, 1990

[51] Int. Cl.[5] ..... B65D 75/00

[52] U.S. Cl. ..... 206/457; 206/8; 206/508; 206/509

[58] Field of Search ..... 206/457, 8, 508, 509

[56] References Cited

U.S. PATENT DOCUMENTS

| | | | |
|---|---|---|---|
| 540,697 | 6/1895 | Shulin | 206/457 |
| 2,317,554 | 4/1943 | Risch | 206/457 |
| 2,484,776 | 10/1949 | Zent et al. | 206/457 |
| 2,868,361 | 1/1959 | Zilem et al. | 206/457 |
| 3,907,416 | 4/1970 | Douglas et al. | 206/457 |
| 3,982,628 | 9/1976 | Grodenas | 206/457 |
| 4,815,999 | 3/1989 | Ayon et al. | 206/457 |

FOREIGN PATENT DOCUMENTS

| | | | |
|---|---|---|---|
| 1180045 | 2/1970 | United Kingdom | 206/457 |

*Primary Examiner*—Joseph Man-Fu Moy
*Attorney, Agent, or Firm*—Robic

[57] ABSTRACT

A toy packaging is disclosed, which comprises a generally cylindrical container having an open end that is closable by a cap, and, in combination with this container, the toy hat that is removably fixable onto the upper end of the container, the hat having a cut-shaped portion sized to fit onto a child's head. Advantaeously, the cup-shaped portion of the toy hat is of such a diameter as to snuggly fit onto the upper end of the container, and a full-sized picture of a child's face is provided onto the wall portion of this container adjacent the upper end thereof. Thereby, when the toy hat is press-fitted onto the container, it seems to be worn by the child whose face is on the picture. This toy packaging is particularly well designed for use to sell, store and put away toys construction blocks including coupling elements making them detachably stackable onto the other. In this particular case, the toy hat may also comprise, on some portions thereof, coupling elements similar to, or compatible with those of the toy construction blocks.

11 Claims, 3 Drawing Sheets

TOY PACKAGING

The present invention relates to a new kind of packaging which is not only a packaging per se for use in selling and/or putting away goods, but is also a toy.

More specifically, the present invention relates to a toy packaging which is particularly convenient and attractive from a commercial standpoint, and which is particularly well designed for use to sell, store and put away toy construction blocks.

The manufacturers of toy construction blocks like those sold by INTERLEGO A.G. under the trademarks LEGO ® and DUPLO ® or by other companies having their other trademarks, such as TYCO ®, usually offer their products for sale in containers in the form of buckets that can be used by the young consumers for storing or putting away their toy construction blocks. Structurally, these buckets do not distinguish from buckets for any other uses, except for their strength and colours that are selected to make them resistant and attractive to children.

The Applicant which is also a manufacturer of toy construction games, has started for the last few months to sell his own blocks called MEGA WEE ® and MEGA ALL ®, within buckets having sidewall panels with appropriate apertures for receiving the coupling elements at least some of the toy construction blocks contained therein. The bottom panel and cover of these buckets are also formed with coupling elements intended to match with cooperating construction blocks. These particular buckets are particularly interesting inasmuch as they serve as a complement to the toy construction kit.

SUMMARY OF THE INVENTION

The object to the present invention is to provide a toy packaging for use to sell goods, especially to children, which packaging does not only serve as a container for the goods to be sold, but also as a toy per se.

In accordance with the invention, this object is achieved with the toy packaging comprising:

a generally cylindrical container having a vertical axis, the container being hollow and having upper and lower ends, one of these two ends being open;

closure means preferably consisting of a cap removably fixed in any suitable manner onto the open end of the container to close the same; and a toy hat removably mounted onto the upper end of the container, the toy hat having a cut-shaped portion sized to fit onto a child's head.

Advantageously, the cup-shaped portion of the toy hat is of such a diameter as to snuggly fit onto the upper end of the container so as to make the toy hat is removably fixable onto the container by snuggly fitting its cup-shaped portion onto the upper end of this container.

According to a particularly preferred embodiment of the invention, a full-sized picture of a child's face is printed, glued or otherwise held in position onto a wall portion of the container adjacent in upper end thereof. Thereby, when the toy hat is fitted onto the container, it seems to be worn by the child whose face is on the picture. Such a child's face display is particularly attractive, especially for young children who can figured how they will look if they wear the toy hat.

The toy packaging according to the invention can be used for selling, storing and/or putting away small construction toy blocks having coupling elements making them detachably stackable one onto the other. In such a case, the toy hat preferably comprises, on some portions thereof, coupling elements similar to or compatible with those of the toy construction blocks. In this particular embodiment, the toy hat can be made of rigid plastic material and can be shaped as a hard-hat similar to those worn by the construction workers.

A preferred embodiment of the invention will now be described with reference to the appended drawings.

DESCRIPTION OF THE PREFERRED EMBODIMENT OF THE INVENTION

The toy packaging 1 according to the invention as shown in the accompanying drawings comprises a generally cylindrical container 3 having a vertical axis. The container which is preferably made of a transparent plastic material to give a visual "access" to its content is hollow and intended to be used for storing and/or putting away sundry articles. In the particular embodiments shown in the accompanying drawings, these articles consist of small toy construction blocks similar to those sold by the Applicant under the trademarks MEGA PLUS and MEGA WEE. It must be understood however that other kind of goods could also be sold within the container 3, such as, for example, marbles, toy soldiers and the like. As a matter of fact, the container 3 could even be used for selling food, such as bubble gums or popcorn.

Figure 2:
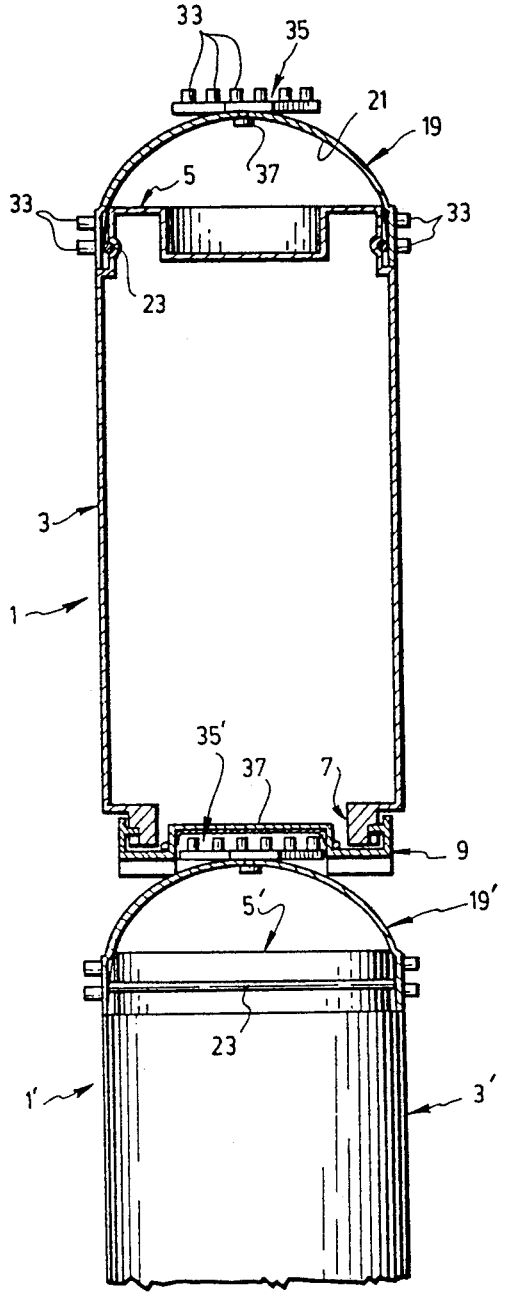
FIG. 2 is an elevational, cross-sectional view of the toy packagings shown in FIG. 1, in stacked position.
Figure 4:
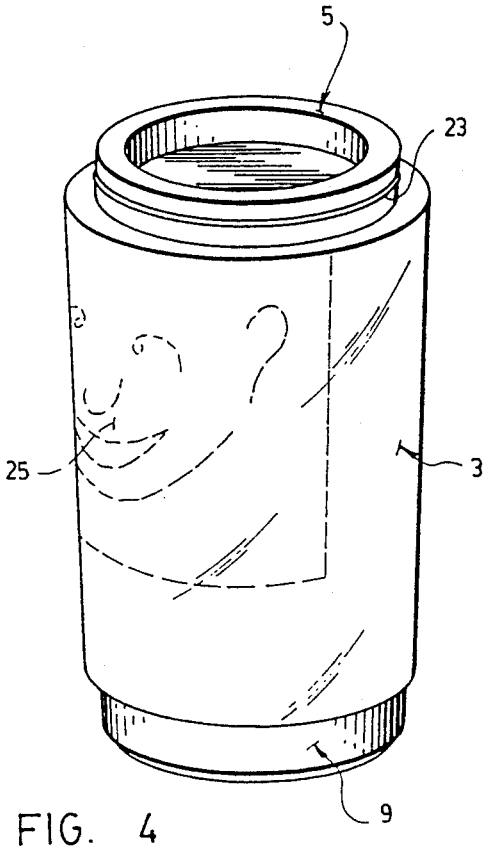
FIG 4 is a perspective view of the container of the toy packaging shown in FIGS. 1 and 2, with the toy hat removed.
Figure 5:
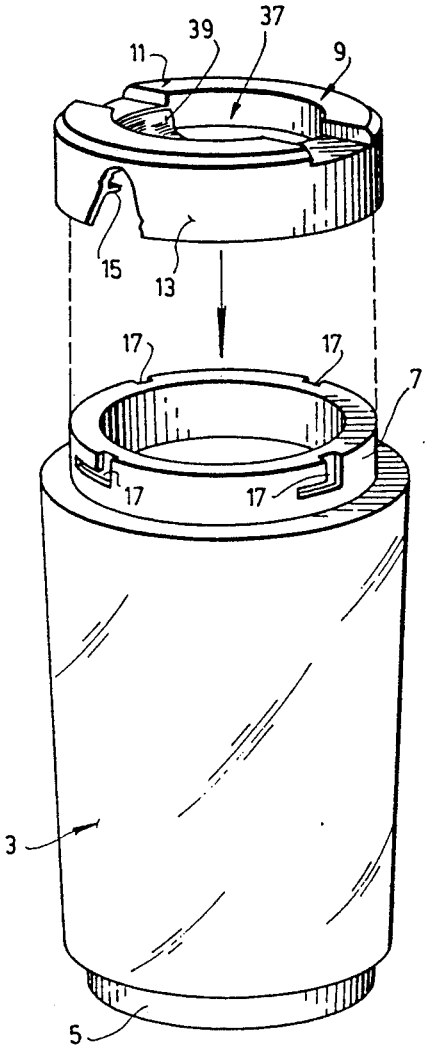
FIG. 5 is a perspective view of the container of the toy packaging shown in FIGS. 1 and 2, in upside down position, showing its closure cap in removed position.

As better shown in FIGS. 2, 4 and 5, the container 3 has an upper end 5 and a lower end 7. One of these two ends, preferably the lower one 7, is open to give access to the inside of the container 3.

Closure means consisting of a plastic cap 9, are provided to close the lower open end 7 whenever required. For this purpose, the cap 9 is provided with fixation means of the bayonet type making it detachably fixable onto the lower, open end 7 of the container 3.

Figure 6:
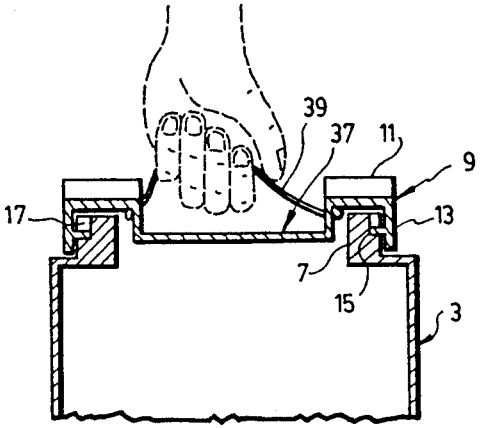
FIG. 6 is an elevational, cross-sectional view showing the upper portion of FIG. 5 when the closure cap is fixed onto the container.

More particularly, as is better shown in FIGS. 5 and 6, the cap 9 is provided with an upper, circular surface 11 from which projects an annular skirt 13 sized to snuggly fit onto the lower open end 7 of the container 3, which is formed as an annular neck. Pins 15 project radially inwardly from the skirt 13 of the cap 9, at given intervals all around the same. Each pin 15 is intended to engage a corresponding L-shaped slot 17 provided into the annular neck forming the lower open end 7 of the container 3. Of course, to allow engagement, one of the arm of the L-shaped slot 17 has to open on top of the neck 7 as shown in FIG. 5.

As can be easily understood in view of FIG. 5, fixation of the cap onto the container 3 can be made by aligning the inwardly projecting pins 15 of the cap 9 with the slots 17, then moving the cap 9 down until the pins reach the bottom of the vertical arms of the slots 17, and then rotating the cap 9 to move the pins 15 along the horizontal arms of the L-shaped slot 17 until the cap is locked. To make this fixation positive, the horizontally extending arm of the slot 17 may taper downwardly. This kind of fixation is well known in the art and usually called "bayonet".

In accordance with the invention, the toy packaging 1 further comprises a toy hat 19 removably mounted onto the upper end 5 of the container.

The toy hat 19 is preferably made of rigid plastic material of right colour and can be of any shape. However, when the toy packaging is intended, for example, to sell toy construction blocks, this hat is preferably shaped as hard-hat very similar to those worn by construction workers. Of course, if the container 3 is intended to be used for selling toy soldiers, the toy hat 19 should be shaped as a helmet.

In accordance with the invention, the toy hat 19 as a cup-shaped portion 21 sized to fit onto a child's head. This cup-shaped portion 19 is advantageously of such a diameter as to snuggly fit onto the upper end 5 of the container 3 which, for this purpose, is advantageously shaped as a short cylinder integral to and coaxial with the body of the container 3 even though it preferably has a diameter which is slightly smaller from the one of this body. Thus, the toy hat 19 can be removably mounted onto the container by merely press-fitting its cup-shaped portion 21 onto the upper end 5 of the container 3.

To make the connection between the toy hat and the upper end 5 of the container 3 much more efficient, an O-ring 23 made of rubber material can be inserted into a groove provided for this purpose at substantially mid-height of the cylindrically shaped upper end 5 (see FIGS. 2 and 4).

Advantageously, the toy packaging 1 further comprises a full-sized picture of a child's face located onto a wall portion of the container 3 adjacent the upper end thereof. When the container is made from a non-transparent material, the picture has to be printed or glued onto the external surface of the container. When, however, the body of the container 3 is made of transparent plastic material, the picture may be inserted into the container through the open end 7 and attached within the container adjacent the top end 5, by any suitable means (glue, tape, etc.)

Figure 1:
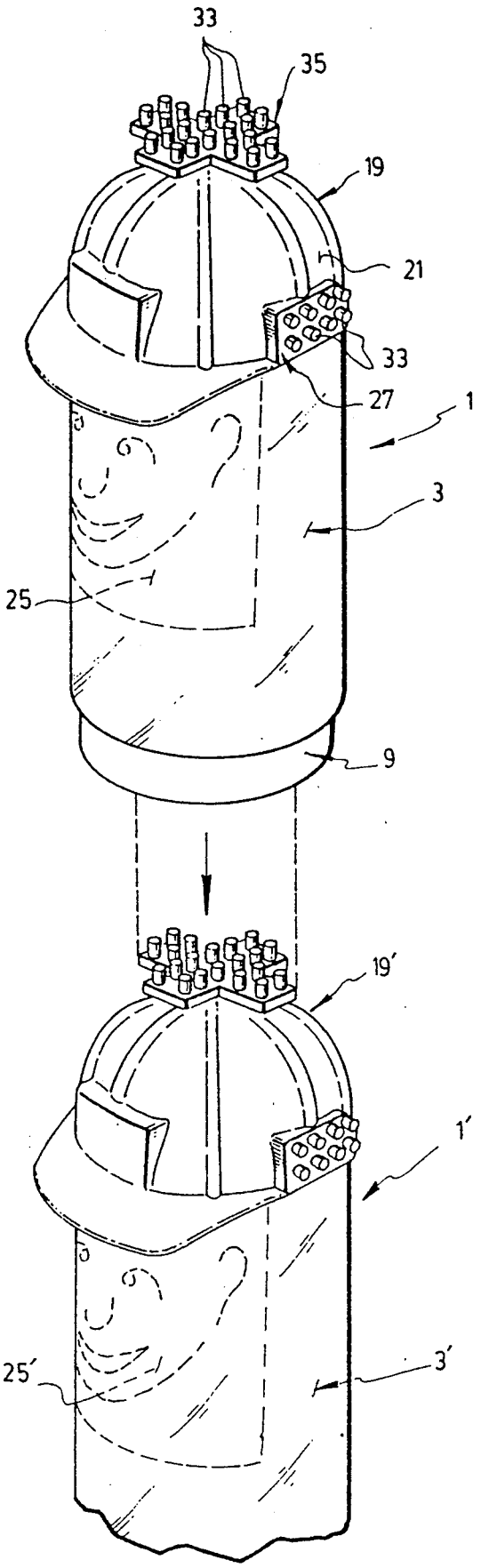
FIG. 1 is a perspective view of a toy packaging according to the invention, ready to be stacked over another similar toy packaging as shown in part only.

The main advantage of using such a full-sized picture of a child is that, when the toy hat 19 is press-fitted onto the upper end of the container 3 as it is shown in FIG. 1, it seems to be worn by the child whose face is on the picture 25. This makes the packaging very attractive and immediately and make it evident for the children and their parent that the packaging 1 is not only a packaging per se but also a toy.

As aforesaid, the toy packaging 1 is particularly well designed to sell, store and put away small toy construction blocks like sold under the trademarks LEGO, DUPLO, TYCO, MEGA WEE, MEGA ALL and the like, including coupling elements making them detachably stackable one onto the other. Examples of such toy construction blocks well known in the trade are disclosed, by way of example, in U.S. Pat. Nos. 3,005,282 and 3,597,875 both belonging to INTERLEGO AG, and in Applicant's copending application Ser. No. 07/286,852 filed on Dec. 19, 1989.

In this particular application, the toy hat 19 may advantageously comprise, on some portions thereof, coupling elements similar to or compatible with those of the toy construction blocks sold within the container 3.

Figure 3:
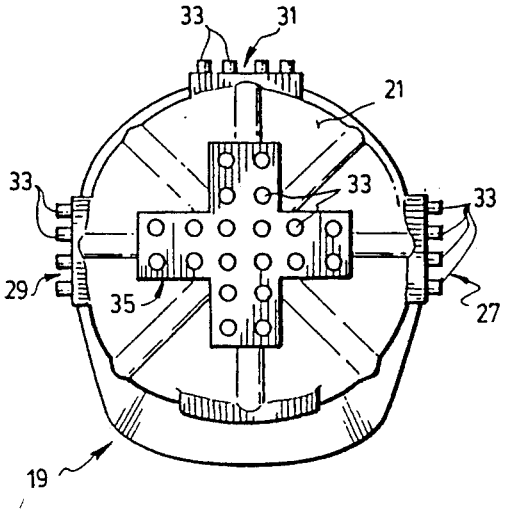
FIG. 3 is a top plan view of the top hat of the toy packaging shown in FIG. 1.

As better shown in FIGS. 1 and 3, the toy hat has, in this particular application two lateral portions 27, 29 and a rear portion 31 each provided with the flat, vertical rectangularly-shaped surface from which coupling elements 33 similar to or compatible with those of the toy construction blocks sold into the container 3 project. The toy hat may also be provided with a flat, cross-shaped member 35 extending horizontally on top thereof, the member 35 having four arms of identical shape comprising a set of similar or compatible coupling elements 33. Advantageously, the member 35 can be mounted onto the top of the hat 19 on vertical a pivot 35 (see FIG. 2), thereby making it rotatable with respect to the hat.

The coupling elements 33 preferably consist of an even number of pegs that are identical in size and have their axis disposed at the corner of adjacent squares, as is known per se (see the above mentioned patents and patent applications). If desired, each peg can be hollowed out as is known and suggested in U.S. Pat. No. 3,597,875. The peg may be cylindrical as shown in the accompanying sketches or polygonal as disclosed in the above mentioned Applicant's copending application. As a matter of fact, the only requirement is that the pegs be compatible with and/or similar to the pegs of the blocks being sold within the container 3.

As can now be easily understood, the top hat cannot only serve as a hat per se, but also as a complement to the toy construction kit being solid within the packaging 1.

In order to make a plurality of toy packaging 1, 1', etc. stackable one above the other (see FIGS. 1 and 2), the lower end 9 of the container is provided with the central recess 37 wide and deep enough to receive the cross shaped member 35' to the toy hat 19' of another toy packaging 1' located below it. As clearly shown in FIG. 2, this feature makes the toy packaging 1 stackable onto the similar toy packaging 1'.

Last of all, to facilitate handling of the container, a handle 39 that can be in the form of a non rigid strap can be fixed onto the cap 9 as is shown in FIGS. 5 and 6. This handle make it possible to hand-carry the toy packaging 1 or, at least, the container 3 upside down when the same is closed. Because this handle is in the form of a strap, it does not "clog" the recess 37 and thus makes the toy packaging 1 still to stackable one onto another.

The embodiments of the invention in which an exclusive property or privilege is claimed are defined as follows:

1. A toy packaging comprising:

a hollow cylindrical container for containing sundry articles, said container having an open end and a closed end;

means removably fixed to said open end to close said open end; and a toy hat mounted on one of said ends so as to be completely removable therefrom, said toy hat having a cup-shaped portion sized to fit over a child'-head;

wherein said cup-shaped portion of said toy hat is of such a diameter as to snugly fit onto said one end of said container;

wherein said toy hat is removably mounted onto said container by press-fitting of said cup-shaped portion onto said one end of said container; and wherein said packaging further comprises a full-sized picture of a child's face onto a wall portion of said container adjacent said one end, whereby, when said toy hat is pressed-fitted onto said container, it seems to be worn by said child whose face is on the picture.

2. A toy packaging for use to sell, store and put away small toy construction blocks including coupling elements making them stackable one onto the other, said toy packaging comprising:

a generally cylindrical container having a vertical axis, said container being hollow and having upper and lower ends, one of the said ends being open;

closure means removably fixed onto said open end of the container to close the same; and a toy hat removably mounted onto said upper end of said container, said toy hat having a cup-shaped portion sized to fit onto a child's head, wherein said cup-shaped portion of said toy hat is of such a diameter as to snugly fit onto said upper end of said container and wherein said toy hat is removably mounted onto said container by press-fitting of said cup-shaped portion onto said upper end of said container, a full-sized picture of a child's face onto a wall portion of said container adjacent said upper end, whereby, when said toy hat is press-fitted onto said container, it seems to be worn by said child whose face is on the picture, and wherein said toy hat further comprises, on some portions thereof, coupling elements similar to or compatible with those of said toy construction blocks.

3. The toy packaging of claim 2, wherein said toy hat has two lateral portions and a rear portion each provided with a flat vertical, rectangularly-shaped surface from which said similar or compatible coupling elements project, said elements consisting of an even number of pegs that are identical in size and have their axes disposed at the corners of adjacent squares, and wherein said toy hat is also provided with a flat cross-shaped member extending horizontally on top thereof, said member having four arms of identical shape and comprising an even number of additional pegs identical in size to those previously mentioned, these additional pegs extending upwardly and having their axes at the corners of adjacent squares extending all over said member along the four arms thereof.

4. The toy packaging of claim 3, wherein the lower end of said container is provided with a central recess wide and deep enough to receive said cross-shaped member extending on top of said toy hat so as to make a plurality of said toy packaging stackable one above the other.

5. The toy packaging of claim 4, wherein:

said open end of said container is the lower end thereof;

said closure means is detachably mounted onto said lower, open end by fixation means of the bayonet type;

said closure means consists of a cap; and said cap has a central recess wide and deep enough to receive said cross-shaped member extending on top of said toy hat so as to make a plurality of said toy packagings stackage one above the other.

6. The toy packaging of claim 5, wherein said closure means includes a handle for use to hand-carry upside down said toy packaging when it is closed.

7. The toy packaging of claim 2, wherein said toy hat is made of rigid plastic material and is shaped as a hard-hat.

8. The toy packaging of claim 4, wherein said toy hat is made of rigid plastic material and is shaped as a hard-hat.

9. The toy packaging of claim 6, wherein said toy hat is made of rigid plastic material and is shaped as a hard-hat.

10. The toy packaging of claim 2, wherein:

said open end of said container is the lower end thereof; and said closure means is detachably mounted onto said lower, open end by fixation means of the bayonet type.

11. The toy packaging of claim 3 wherein:

said open end of said container is the lower end thereof; and said closure means is detachably mounted onto said lower, open end by fixation means of the bayonet type.

* * * * *